United States Patent [19]

Byrne et al.

[11] Patent Number: 4,468,298

[45] Date of Patent: Aug. 28, 1984

[54] DIFFUSION WELDED NONCONSUMABLE ELECTRODE ASSEMBLY AND USE THEREOF FOR ELECTROLYTIC PRODUCTION OF METALS AND SILICON

[75] Inventors: Stephen C. Byrne, Monroeville; Asuri K. Vasudevan, Pittsburgh, both of Pa.

[73] Assignee: Aluminum Company of America, Pittsburgh, Pa.

[21] Appl. No.: 451,070

[22] Filed: Dec. 20, 1982

[51] Int. Cl.[3] ..... C25C 3/03; C25C 3/06; C25C 3/12; C25C 3/34

[52] U.S. Cl. ..... 204/60; 204/64 R; 204/64 T; 204/66; 204/67; 204/70; 204/286; 204/292

[58] Field of Search ..... 204/60, 64 R, 64 T, 204/66, 67, 70, 286, 243 R, 290 R, 290 F, 291, 292

[56] References Cited

U.S. PATENT DOCUMENTS

| | | | |
|---|---|---|---|
| 3,022,195 | 2/1962 | Hackley et al. | 117/123 |
| 3,152,871 | 10/1964 | Matchen | 29/195 |
| 3,284,174 | 11/1966 | Zimmer | 29/183.5 |
| 3,414,963 | 12/1968 | Cheng | 29/470.3 |
| 3,718,550 | 2/1973 | Klein | 204/67 |
| 3,839,779 | 10/1974 | Walker | 29/472.9 |
| 3,911,553 | 10/1975 | Burgess et al. | 228/173 |
| 3,915,369 | 10/1975 | Schmidt-Bruecken et al. | 228/194 |
| 3,960,678 | 6/1976 | Alder | 204/67 |
| 3,993,411 | 11/1976 | Babcock et al. | 403/271 |
| 3,994,430 | 11/1976 | Cusano et al. | 228/122 |
| 4,187,155 | 2/1980 | DeNora | 204/67 |

OTHER PUBLICATIONS

Billehaug, Kari and Øye, H. A. "Inert Anodes for Aluminum Electrolysis in Hall-Heroult Cells (I)", *Aluminium*, vol. 57, #2, 1981, pp. 146-150.

Billehaug, Kari and Øye, H. A., "Inert Anodes for Aluminum Electrolysis in Hall-Heroult Cells (II)", *Aluminium*, vol. 57, #3, 1981, pp. 228-231.

*Primary Examiner*—Howard S. Williams

*Attorney, Agent, or Firm*—Max L. Williamson

[57] ABSTRACT

A nonconsumable electrode assembly suitable for use in the production of metal by electrolytic reduction of a metal compound dissolved in a molten salt, the assembly comprising a metal conductor diffusion welded to a portion of a ceramic electrode body having a level of free metal or metal alloy sufficient to effect a metal bond.

14 Claims, 5 Drawing Figures

DIFFUSION WELDED NONCONSUMABLE ELECTRODE ASSEMBLY AND USE THEREOF FOR ELECTROLYTIC PRODUCTION OF METALS AND SILICON

The Government has rights in this invention pursuant to Agreement No. DE-FC07-80CS40158 awarded by the U.S. Department of Energy.

BACKGROUND OF THE INVENTION

This invention relates to a method of connecting a metallic electrical conductor to an electrically conductive ceramic electrode body to make an electrode assembly which is suitable for use in producing metal by electrolysis.

A number of materials including silicon and metals such as aluminum, lead, magnesium, zinc, zirconium, and titanium for example, can be produced by electrolytic processes. Although individual processes may vary in some respects from one to another, each employs the use of an electrode which must operate in a highly corrosive environment.

An example of such a process for the production of metal is the well-known Hall-Heroult process (hereinafter referred to as the Hall process) for producing aluminum in which alumina dissolved in a molten fluoride salt bath is electrolyzed at temperatures from 900° C. to 1000° C. In the process as generally practiced today, carbon is used as an anode to reduce the alumina, and the reduction produces molten aluminum, and the carbon is oxidized to primarily form $CO_2$ which is given off as a gas. Despite the common usage of carbon as anode material in practicing the Hall process, there are a number of disadvantages to its use.

Since carbon is consumed in relatively large quantities in the Hall process, approximately 420 to 550 kg per ton of aluminum produced, the anode must be constantly repositioned or replenished to maintain the proper spacing with the cathode in the cell to produce aluminum efficiently. If prebaked anodes are used, it may be seen that a relatively large facility is needed to produce sufficient anodes to operate an aluminum smelter. Furthermore, to produce the purity of aluminum required to satisfy primary aluminum standards, the anode must be relatively pure carbon, and availability and cost of raw materials to make the carbon are of increasing concern to aluminum producers.

Because of the disadvantages inherent in the use of carbon as an anode, there has been a continuing search for inert or nonconsumable materials that can operate as an anode with a reasonable degree of electrochemical efficiency and withstand the high temperature and extremely corrosive environment of the molten salt bath. A number of different types of materials have been suggested and tried, including ceramic oxides, metals and ceramic transition metal borides and carbides, and gaseous fuels, such as natural gas or hydrogen, as the reactant in a fuel-cell type anode. From published literature, few, if any, materials tried will survive for a prolonged time in an aluminum electrolysis cell; however, some ceramic oxides have been reported to be corrosion resistant during cell operation. A recent review of literature and patents relating to inert anodes for use in producing aluminum may be found in articles entitled "Inert anodes for aluminum electrolysis in Hall-Heroult cells (I)" by Kari Billehaug and H. A. Øye, Volume 57, #2, *Aluminium,* 1981, and "Inert anodes for aluminum electrolysis in Hall-Heroult cells (II)" by Kari Billehaug and H. A. Øye, Volume 57, #3, *Aluminium,* 1981.

A major problem in the development and use of nonconsumable anodes for producing aluminum by electrolysis has been that of providing a satisfactory method for making a connection between an electrically conductive ceramic material and a metal conductor leading from the cell to a power source. In a typical operation of a Hall cell using carbon as the anode, the anode is formed into a block having a rectangular cross section and a metallic rod or bar is embedded therein by providing a hole in the block, inserting the rod in the hole and filling the void between the rod and the block with molten iron. When the iron solidifies, it shrinks tightly around the bar and away from the hole surfaces of the carbon block, but disengagement is prevented by adapting the block so as to engage the solidified iron. Such an adaptation is providing recesses in the hole side wall, for example. When the above-described assembly is positioned in a Hall cell having a salt bath which is maintained at approximately 1000° C., the rod, cast iron and carbon in the connection zone rise in temperature from room temperature to approximately 700° to 800° C. The rod, cast iron and carbon in the connection zone expand due to this temperature rise and a substantially tight and reasonably efficient electrical connection is effected. Because the rod and cast iron are relatively free to expand longitudinally, the principal electrical contact between the body and the metal due to the thermal expansion is along the lateral surfaces.

When ceramic materials are used for anode bodies, however, such a connection is not satisfactory for a number of reasons.

When using carbon as the anode body, it is desirable that it be in a block form because it is consumed during the electrolytic process and a large block or mass minimizes the frequency with which anodes must be replaced. It is not desirable, on the other hand, to provide an anode of ceramic materials in a large mass or block because, typically, ceramic anode bodies are more expensive to make than are carbon anode bodies, and the carbon materials are typically better conductors of electricity than are ceramic materials used in inert anodes.

As has been previously noted, the carbon anode to metal bar connection utilizing cast iron as the connecting medium relies primarily upon the lateral surfaces of the cast iron being in substantially tight contact with the lateral surfaces adjacent the hole in the carbon block to effect a reasonably satisfactory electrical connection. Variations in electrical conductivity of such a connection due to such things as irregularities in the cast iron and carbon block surfaces, for example, may be tolerated because of the relatively short time span over which an individual carbon block functions as an anode. In the case of an anode made from ceramic materials, however, most of the ceramic materials which are suitable for use as anodes are less efficient electrical conductors than carbon and, furthermore, to be effective, the anode must function over an extended period of cell operation time. Assuring a continuous intimate contact between the ceramic anode body and metal conductor is considered to be more critical, therefore, than the contact required between a carbon block and metal conductor.

Ideally, the connection of a nonconsumable anode material to a metal conductor for use in the electrolytic production of metal must be corrosion resistant, have a minimal voltage drop across the connection, and function to maintain the integrity of the ceramic material when subjected to temperature differentials on the order of 1000° C.

A number of methods for making connections of ceramic materials to metal conductors in the electroytic production of aluminum have been proposed. Klein U.S. Pat. No. 3,718,550, proposes three different methods. In one of the methods, a ceramic anode tube, having a closed end, contains molten silver and a titanium carbide rod connected to a current supply extends down into the molten silver pool. In a second method, the inner surface of the tube is covered with a thin layer of silver or platinum and a hollow cylinder of nickel-alloy wire mesh is inserted into the tube to contact the silver or platinum layer and is connected with nickel-alloy wires to a conductor leading to the current supply. In the third method, the closed-end ceramic anode tube contains nickel powder, and a rod of zirconium diboride connected to a conductor leading to the current supply is inserted into the nickel powder. Alder U.S. Pat. No. 3,960,678, shows ceramic anode bodies of various shapes in contact with the electrolyte. Adjacent to the anode, but not in contact with the electrolyte, is a material designated as a current distributor which may be a metal such as Ni, Cu, Co, Mo or molten silver or a non-metallic material such as a carbide, nitride or boride. Power leads connected to the current distributor may be made of the same materials, and it is suggested that the current distributor and power lead may be a single piece. The patentee does not describe how the various connections are to be made. De Nora et al U.S. Pat. No. 4,187,155, suggests attaching lead-in connectors to ceramic electrodes by fusing the connector into the electrode during the molding and sintering process or by making an attachment after sintering, but does not describe any method for making such attachments so as to avoid fracture of the ceramic in use.

Suggestions or descriptions for making metal bonds between ceramics and metals by welding, brazing or other methods of metal bonding have been made. Patents dealing with such methods, for example, are Hackley et al U.S. Pat. No. 3,022,195, Cheng U.S. Pat. No. 3,414,963, Matchen U.S. Pat. No. 3,152,871, Zimmer, U.S. Pat. No. 3,284,174, Walker U.S. Pat. No. 3,839,779, Burgess et al U.S. Pat. No. 3,911,553, Schmidt-Bruecken et al U.S. Pat. No. 3,915,369, Babcock et al U.S. Pat. No. 3,993,411 and Cusano et al U.S. Pat. No. 3,994,430. None of these patents, however, are concerned with connecting an electrically conductive metallic oxide ceramic electrode body to a metal conductor for use in producing a metal by electrolysis. Heretofore, it has not been believed possible to make such a connection in producing a metal because of fracture or failure of the joint due to expansion and/or contraction of the assembly over the extreme temperature differential involved in production of metal by electrolysis.

It would be desirable, therefore, to provide a method for joining a ceramic body to a metal conductor for use in producing metal by electrolysis.

SUMMARY OF THE INVENTION

This invention is for an assembly of a nonconsumable ceramic electrode body and a metal conductor which is suitable for use in the production of metal by electrolytic reduction of a metal compound dissolved in a molten salt. The assembly is effected by providing a metal bond between the metal conductor and the ceramic body, the metal bond formed by diffusion welding the metal conductor to the ceramic body. The ceramic body may be comprised of any ceramic and/or combinations of metals and ceramics which are suitable for use as an electrode in a process for producing metal by electrolysis and includes in at least the portion of the body to be connected to the metal conductor a level of free metal or metal alloy sufficient to effect a metal bond. It is to be understood that the word "ceramic" as used herein with reference to this invention is intended to include those combinations of ceramics and metals commonly referred to as cermets. In the practice of this invention, such free metal or metal alloy of such ceramic must have a higher melting temperature than the maximum temperature the ceramic body will be subject to during the operation of a cell in producing a particular metal by electrolysis. In producing aluminum, for example, ceramics which include Ni or NiFe as a free metal or metal alloy are suitable for use in an assembly of this invention, but the subject invention is not limited to the examples just cited. Other metals suitable as free metals or in combination as metal alloys include, for exsmple, Fe, Al, Mg, Ca, Co, Sn, Ti, Cr, Mn, Zr, Cu, Nb, Ta, Li, Y, Pt, Pd and Ir. Further, the scope of this invention is intended to include any electrode body which may have a suitable ceramic layer as an exterior surface. For example, it has been suggested that an electrode might be made by flame spraying or plasma spraying a coating of ceramic material onto a base material such as titanium, nickel, copper, a carbide, a nitride, etc. Ceramic materials which have shown the best potential heretofore for use as inert electrodes in an electrolytic process for producing metal are metal oxides and combinations of metals and metal oxides called cermets, but it is not intended that this invention is limited to metal oxide and/or cermet materials.

The free metal or metal alloy may be provided by at least partially reducing by the use of a suitable reductant at least one of the metal compounds present in the ceramic body in an area where the metal bond is to be effected. Other methods of providing an essentially metallic connecting surface on the anode might also be suitable. For example, free metal might be provided in a cermet by introducing metal particles into a ceramic mixture prior to sintering. As an alternative, a layer of metal might be applied to the surface of the ceramic body to be connected by plating, plasma spraying or chemical vapor deposition, for example. After providing the metal in a manner proposed by the foregoing examples, a metal bond between the ceramic anode body and metal conductor rod can be made.

The metal conductor may be any metal that is suitable for use as a conductor in a particular electrolytic process, can be joined to the electrode body with a metal bond connection by diffusion welding, and is compatible with the electrode in the cell environment. That is, no adverse reaction between the ceramic material and the metal arises from the connection of the two materials.

For purposes of this invention, the term "metal bond" is intended to mean a bond that is formed between the metal conductor and the free metal or metal alloys in the ceramic body by diffusion welding.

In diffusion welding, a joint or connection is effected between two articles by the migration of particles from one article to another or by a mutual migration of particles between the articles when a surface of one article is in intimate contact with a surface of the other article. Application of pressure, heat, or a combination of heat and pressure, to the contacting surfaces hastens the diffusion of at least some of the material in one article into the other article to effect a connection.

It is an object of this invention to provide an assembly between an inert ceramic electrode body and a metal conductor that is suitable for use in producing metal by an electrolytic process and is economical, reliable and efficient in such use.

This and other objects and advantages will be more apparent with reference to the following description of a preferred embodiment and the accompanying drawings.

DESCRIPTION OF A PREFERRED EMBODIMENT

For convenience, a preferred embodiment of this invention will be described with reference to producing aluminum by electrolysis, but the scope of the invention is intended to include its use in the production of other metals by electrolysis as well.

In this preferred embodiment any ceramic material may be used for the body that is suitable for use as an anode in the electrolytic production of aluminum and includes therein at least in the portion of the body to be joined to the metal conductor a level of free metal or metal alloy sufficient to effect a metal bond between the conductor and ceramic body by diffusion welding. A preferred composition of the ceramic body is comprised of metal oxides and a more preferred composition of materials is 20 wt.% Fe, 60 wt.% NiO and 20 wt.% $Fe_3O_4$. To make an anode body to be used in the practice of this invention, the foregoing materials are placed in a suitably shaped mold and are reaction sintered in an argon atmosphere at a temperature of approximately 1275° to 1350° C. for approximately four hours under a pressure of approximately 25,000 psi (172 MPa). Such reaction sintering results in an interwoven network of metallic material and oxides, the metallic material containing Ni—Fe alloy and the oxide material containing (Ni,Fe)O and $Ni_xFe_{3-x}O_4$. For purposes of this invention, the shape of the body is not critical; it may be of any shape or configuration which provides an accessible surface for making a diffusion welded connection by the selected method.

Figure 1:
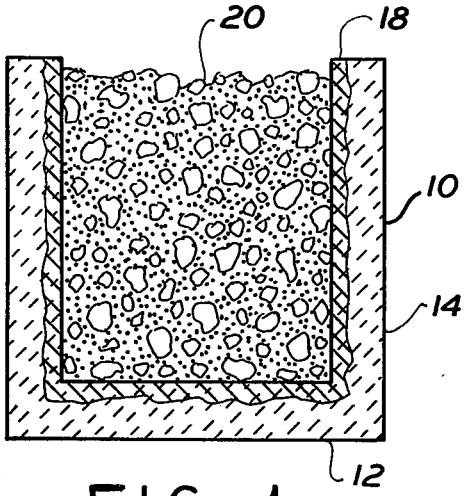
FIG. 1 is a cross-sectional drawing of an electrode body of an assembly of this invention with a reductant in contact with a portion of the body.
Figure 2:
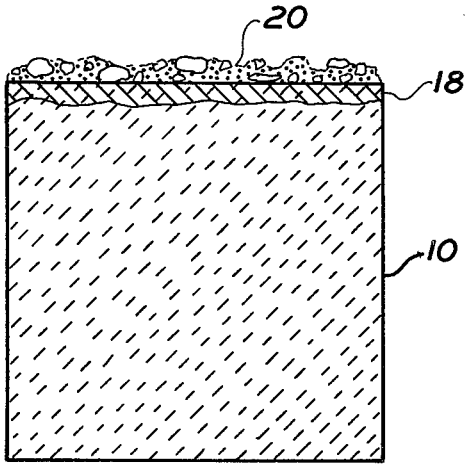
FIG. 2 is a cross-sectional drawing of an alternate electrode body of an assembly of this invention with a reductant in contact with a portion of the body.

Shapes suitable for an assembly of this invention are shown in FIGS. 1 and 2. Referring to FIG. 1, the anode body 10 is a cylindrical cup having a bottom wall 12 and side wall 14. The thickness of the walls need be only that which is adequate to provide the structural strength necessary for the size of anode body required and the corners of the cup may be provided with a radius if desired. FIG. 2 is a solid cylindrical shape 10; however, the body 10 may be of any desired cross section so long as a surface is provided to effect a diffusion weld, as will be explained later.

To provide an appropriate connecting surface on the anode body, an area of connection is reduced by contacting the area with a reducing agent, such as carbon for example, and sufficient heat is applied to reduce the metal oxide or oxides to a metal or metallic alloy form. The manner of using carbon as the reducing agent is noyt critical to the practice of this invention, and suitable temperatures and time to accomplish the desired reduction would be known to one skilled in the art. Typically, the cup 10 is filled with a carbonaceous material 20 and heated to a temperature greater than 900° C. to at least partially reduce a zone 18 of the metal oxide material at and adjacent the surfaces contacted by the carbonaceous material. The time of heating may vary depending upon the extent of reduction desired. Typically, it is believed that the composition of the material in the reduced zone 18 is comprised of Ni, NiFe alloy as free metal and metal alloy in a ceramic matrix of (Ni,Fe)O and $Ni_xFe_{3-x}O_4$.

It is believed that by varying the time and/or temperature of heating, zone 18 could be reduced to substantially all free metal or metal alloy. The extent of reduction required, however, is only that necessary to effect a metal bond between the metal conductor and the ceramic body of sufficient strength to maintain the assembly during its intended use as an anode in an electrolytic process for producing metal.

As an alternative to the use of carbon as a reductant, heating in the presence of hydrogen or a hydrogenous material is a satisfactory method for reducing the metal oxide or oxides to primary metals or metal alloys. Thus, a portion of the anode body is converted to a section that is highly resistant to thermal shock and has a layer including free metal or metal alloy which blends into the ceramic oxide body through a transition zone of variable composition.

Figure 3:
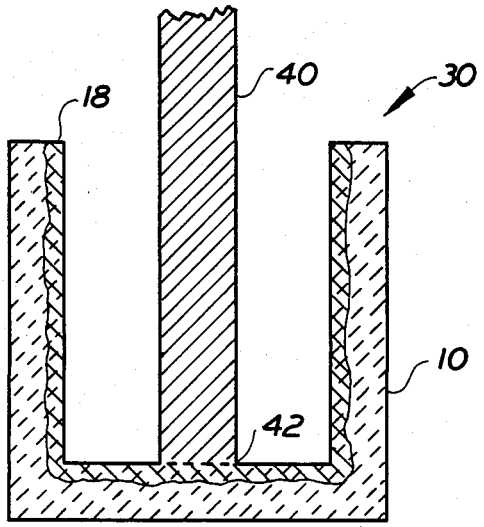
FIG. 3 is a cross-sectional drawing of an assembly of this invention including the electrode body shown in FIG. 1.
Figure 4:
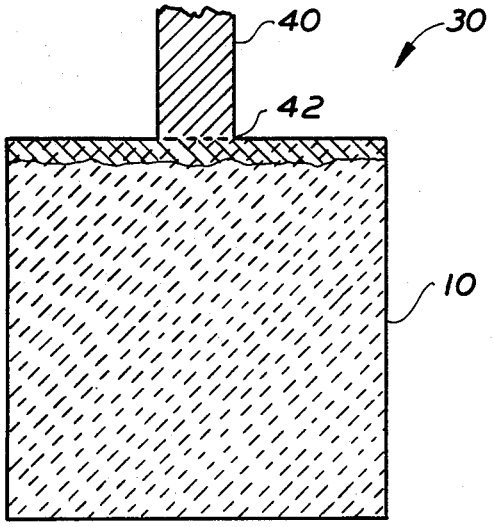
FIG. 4 is a cross-sectional drawing of an assembly of this invention including the electrode body shown in FIG. 2.

To effect an assembly between the ceramic body and metal conductor by diffusion welding, as shown in FIGS. 3 and 4, an end of the metallic rod or bar 40 is placed in intimate contact with the surface of the reduced portion 18 of the body 10 and the assembly is then heated in an inert atmosphere while applying pressure through the contacting surfaces. The amount of heat and/or pressure applied is largely a matter of choice. In general, the greater the heat and pressure, the lesser is the time required to effect an adequate bond. The rod or bar may be comprised of any metal or alloy suitable for making the diffusion weld 42. The weld 42 is shown as a dashed line to indicate that the diffusion weld of an assembly of this invention is a merger of the two boides wherein the metal particles of the two bodies become intermingled and thus a metal bond is provided.

Where the surface of the anode body to be connected contains Ni and NiFe, as in this preferred embodiment, for example, a suitable rod or bar is comprised of Ni or Ni alloy, but it is apparent that other metal alloys capable of being joined by diffusion welding could also be used as metal conductors.

In this preferred embodiment, suitable temperature, pressure and time to effect a diffusion weld are, for example, 1000° C. for 48 hours with 24 pounds of pressure applied longitudinally through the rod from a weight imposed against the upstanding rod end.

Figure 5:
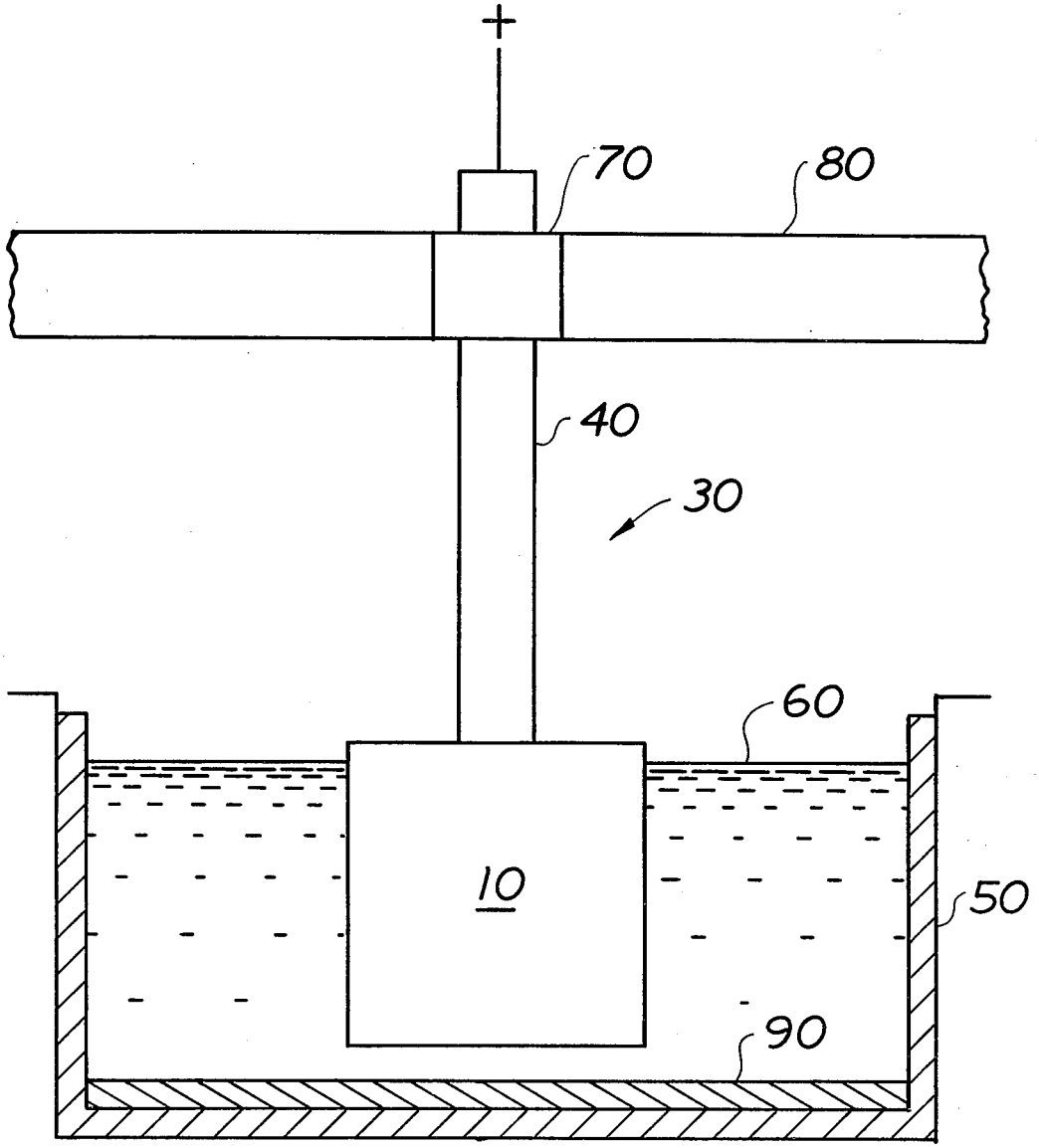
FIG. 5 is a cross-sectional drawing of an electrolytic cell for use in a process for producing aluminum with an assembly of this invention suspended therein.

Use of an assembly of this invention for producing aluminum by a typical electrolytic process is described with reference to FIG. 5. A container 50 suitable for containing a molten salt bath 60 is adapted as a cathode. Suitable cell materials and construction thereof are known to those skilled in the art.

The composition of the molten salt bath 60 is typically comprised of $Al_2O_3$ dissolved in a molten salt wherein the weight ratio of NaF to $AlF_3$ is maintained at approximately 1.1 and the salt bath further includes approximately 5 wt.% $CaF_2$ and 5 wt.% $Al_2O_3$. An anode assembly 30 of this invention as previously described is suspended in the molten salt bath by attaching the metal conductor 40 with a clamp 70 or other suitable suspension means known to those skilled in the art to a support means 80, and a positive lead from a power source is attached to the conductor 40. Preferably, the assembly 30 is suspended in the bath 60 with the upper edge of the anode body 10 above the level of the bath to minimize attack from the salt bath and products of electrolysis on the reduced surface of the body and the metal conductor 40.

In operating the cell, the bath 60 is maintained at approximately 960° C. and a current density of approximately 6.5 amps/in$^2$ (1 amp/cm$^2$) of surface area of the bottom of the anode body 10 is maintained with an anode-to-cathode distance of approximately 1½ inches (38 mm).

The process, when performed in such a manner, causes reduction of the dissolved $Al_2O_3$ with oxygen liberated at the anode 10 and molten aluminum 90 settling and collecting on the bottom of the cell 50.

The following example is offered to further illustrate making a ceramic oxide body to metal conductor connection by a method of this invention.

EXAMPLE

A cup-shaped ceramic metallic oxide body approximately 75 mm O.D.×55 mm I.D.×70 mm high was produced from 20 wt.% Fe, 60 wt.% NiO and 20 wt.% $Fe_3O_4$ materials. The materials were mixed and placed in a rubber or flexible cup-shaped mold and reaction sintered in an argon atmosphere at a pressure of 20 ksi and 1350° C. for 12 hours.

The cup was then filled with carbon mastic cement and heated in an argon atmosphere at a temperature of 1075° C. for 24 hours to reduce at least the bottom interior surface of the cup to provide a zone adjacent the surface which included Ni or Ni and NiFe.

A nickel 200 alloy rod 1½ inches in diameter×approximately 6 inches long was positioned within the cup with the bottom rod surface in intimate contact with a portion of the bottom interior surface of the cup. The cup-rod assembly was then heated in an argon atmosphere at a temperature of 1000° C. for 48 hours with 24 pounds of pressure applied longitudinally through the rod from a weight imposed against the upstanding rod end, and a diffusion welded joint between the anode body and the metal rod was effected.

A boron nitride cover having an opening therethrough to accommodate the 1½ inch diameter rod was then applied over the cup opening, and the seams between the cover and the cup lip and the conductor rod were sealed with a boron nitride paste. Although not considered essential to the invention, the boron nitride cover was provided as a safeguard to prevent the bath or products of electrolysis from contacting the reduced portion of the body, the conductor rod or the diffusion welded connection.

A ⅜ inch diameter nickel 200 alloy rod was then attached to the free end of the 1¼ inch diameter conductor rod and the assembly was suspended in a Hall cell with the lip of the cup above the bath level by connecting the ⅜ inch diameter rod to an overhead bus support.

The Hall cell bath was comprised of 80.7 wt.% cryolite, 12.4 wt.% $AlF_3$, 5.0 wt.% $CaF_2$ and 1.9 wt.% $Al_2O_3$ and was operated at a temperature of approximately 960° C., with an anode current density of 1 amp/cm$^2$ (6.5 amps/in$^2$) and an anode-to-cathode distance of approximately 38 mm (1.5 in).

The cell was operated for 79 hours in producing 820 grams of essentially aluminum metal, and the average connection voltage drop was 0.19 volt.

While the invention has been described in terms of preferred embodiments, the claims appended hereto are intended to encompass all embodiments which fall within the spirit of the invention.

What is claimed is:

1. A nonconsumable electrode assembly for use in the production of an element selected from the group consisting of aluminum, lead, magnesium, zinc, zirconium, titanium and silicon by electrolytic reduction of a compound comprised of such element dissolved in a molten halide salt, the assembly comprising:

a metal conductor for conveying electrical energy;

a ceramic electrode body having free metal or metal alloy in at least an outer surface portion thereof for making a connection between said metal conductor and said ceramic body; and a diffusion welded connection between said metal conductor and said portion of said ceramic electrode body, said connection formed by a diffusion of metal particles between a portion of said metal conductor and said portion of said ceramic body.

2. The assembly in accordance with claim 1 wherein said outer surface portion is a chemically reduced portion of said ceramic electrode body.

3. The assembly in accordance with claim 1 wherein said free metal or metal alloy is selected from the group consisting of Fe, Ni, Al, Mg, Ca, Co, Sn, Ti, Cr, Mn, Zr, Cu, Nb, Ta, Li, Y, Pt, Pd and Ir.

4. The assembly in accordance with claim 1 wherein said ceramic electrode body includes at least one metal oxide.

5. The assembly in accordance with claim 4 wherein said outer surface portion is a chemically reduced portion of said ceramic electrode body.

6. The assembly in accordance with claim 1 wherein said ceramic electrode body includes at least one metal compound comprised of at least two metal oxides.

7. The assembly in accordance with claim 6 wherein said outer surface portion is a chemically reduced portion of said ceramic electrode body.

8. A process for producing an element selected from the group consisting of aluminum, lead, magnesium, zinc, zirconium, titanium and silicon by electrolytic reduction of a compound comprised of such element dissolved in a molten salt, said process including providing a nonconsumable anode assembly by the steps of:

providing a metal conductor for conveying electrical energy;

providing a ceramic electrode body having free metal or metal alloy in at least an outer surface portion thereof for making a connection between said metal conductor and said ceramic body; and connecting said ceramic body to said metal conductor by diffusion welding a portion of said metal conductor and the portion of said ceramic body having the free metal or metal alloy therein, and thereby forming a metal bond between said ceramic body and said metal conductor.

9. A process in accordance with claim 8 wherein said free metal or metal alloy is provided by chemically reducing said outer surface portion of said ceramic body.

10. A process in accordance with claim 8 wherein said free metal or metal alloy is selected from the group consisting of Fe, Ni, Al, Mg, Ca, Co, Sn, Ti, Cr, Mn, Zr, Cu, Nb, Ta, Li, Y, Pt, Pd and Ir.

11. A process in accordance with claim 8 wherein said ceramic electrode body includes at least one metal oxide.

12. A process in accordance with claim 11 wherein said outer surface portion is a chemically reduced portion of said ceramic electrode body.

13. A process in accordance with claim 8 wherein said ceramic electrode body includes at least one metal compound comprised of at least two metal oxides.

14. A process in accordance with claim 13 wherein said outer surface portion is a chemically reduced portion of said ceramic electrode body.

* * * * *